US010343755B2

(12) United States Patent
Gibson

(10) Patent No.: US 10,343,755 B2
(45) Date of Patent: Jul. 9, 2019

(54) GUIDING ARRANGEMENT FOR RETRACTABLE THRUSTER

(71) Applicant: Caterpillar Propulsion Production AB, Öckerö (SE)

(72) Inventor: Johannes Gibson, Gothenburg (SE)

(73) Assignee: Caterpillar Propulsion Production AB, Ockero (SE)

( * ) Notice: Subject to any disclaimer, the term of this patent is extended or adjusted under 35 U.S.C. 154(b) by 408 days.

(21) Appl. No.: 15/101,784

(22) PCT Filed: Oct. 21, 2014

(86) PCT No.: PCT/EP2014/002842
§ 371 (c)(1),
(2) Date: Jun. 3, 2016

(87) PCT Pub. No.: WO2015/082025
PCT Pub. Date: Jun. 11, 2015

(65) Prior Publication Data

US 2018/0162507 A1 Jun. 14, 2018

(30) Foreign Application Priority Data

Dec. 5, 2013 (EP) ..... 13195903

(51) Int. Cl.
*B63H 5/125* (2006.01)
*B63H 23/32* (2006.01)
(Continued)

(52) U.S. Cl.
CPC ..... *B63H 5/125* (2013.01); *B63B 17/0018* (2013.01); *B63H 23/321* (2013.01); *B63H 25/42* (2013.01); *B63H 2025/425* (2013.01)

(58) Field of Classification Search
CPC ..... B63H 25/42; B63H 5/125; B63H 23/321; B63B 17/0018
See application file for complete search history.

(56) References Cited

U.S. PATENT DOCUMENTS 3,483,843 A 12/1969 Hawthorne
5,125,858 A * 6/1992 Salvetti ..... B63H 5/125 440/49

(Continued)

FOREIGN PATENT DOCUMENTS

EP 0 121 505 A2 10/1984
JP S52 41389 A 3/1977

(Continued)

OTHER PUBLICATIONS

International Search Report for Application No. PCT/EP2014/002842 dated Aug. 1, 2015.

(Continued)

*Primary Examiner* — Kevin L Lee

(57) ABSTRACT

The present disclosure relates to a guiding arrangement for a retractable thruster assembly. The guiding arrangement may comprise a foundation plate, a first upper guide, a second upper guide, a first lower guide, and a second lower guide. The first lower guide and the second upper guide may be arranged such that an arc angle within the range from 25° to 75° is confined therebetween. Thus, flexibility regarding the implementation of the retractable thruster assembly as L-drive or Z-drive may be gained.

10 Claims, 5 Drawing Sheets

(51) Int. Cl.
*B63B 17/00* (2006.01)
*B63H 25/42* (2006.01)

(56) References Cited

U.S. PATENT DOCUMENTS

| | | | | |
|---|---|---|---|---|
| 5,397,255 | A | 3/1995 | Werft | |
| 7,992,275 | B1 * | 8/2011 | Bekker et al. | B63B 9/00 29/402.03 |
| 9,623,942 | B2 * | 4/2017 | Schiaffino et al. | B63B 17/0018 |
| 2008/0122181 | A1 | 5/2008 | Grimanis | |
| 2017/0144739 | A1 * | 5/2017 | Ramstedt | B63H 1/14 |

FOREIGN PATENT DOCUMENTS

| | | | |
|---|---|---|---|
| JP | 61261188 | | 11/1986 |
| WO | WO 97/20733 | A1 | 6/1997 |
| WO | WO 99/20524 | A1 | 4/1999 |

OTHER PUBLICATIONS

European Search Report for Application No. 13 195903 dated Apr. 30, 2014.

* cited by examiner

GUIDING ARRANGEMENT FOR RETRACTABLE THRUSTER

CROSS-REFERENCE TO RELATED APPLICATION

This Application is a 35 USC § 371 US National Stage filing of International Application No. PCT/EP2014/002842 filed on Oct. 21, 2014, and claims priority under the Paris Convention to French Patent Application No. 13195903.3 filed on Dec. 5, 2013.

TECHNICAL FIELD

The present disclosure generally relates to thrusters for marine ships and vessels. More particularly, the present disclosure relates to a guiding arrangement for a retractable thruster assembly.

BACKGROUND

Various propulsion systems are known to propel marine vessels. Examples of those propulsion systems are retractable fixed thruster assemblies and retractable azimuth thruster assemblies. Retractable fixed thrusters are not rotatable, whereas retractable azimuth thrusters are rotatable in any horizontal direction.

Regarding the configuration of the drive train for the retractable thruster, Z-drive configurations and L-drive configurations are distinguished. In a Z-drive configuration, the power transmission has two right angle turns, thus resembling the letter "Z". This name is used to differentiate the arrangement of drive to that of the L-drive. In power transmissions with L-drive configuration, the rotary motion has to make one right angle turn, thus looking like the letter "L". Generally, Z-drive configurations are commonly equipped with combustion engines, for example, diesel fuel engines and gaseous fuel engines, as power source for the propeller. In contrast, L-drive configurations are often provided with electric motors as prime movers.

For example, retractable thruster assemblies for marine vessels are known from WO 2012/089914 A1 and WO 2011/031158 A2.

The present disclosure is directed, at least in part, to improving or overcoming one or more aspects of prior systems.

SUMMARY OF THE DISCLOSURE

According to a first aspect of the present disclosure, a guiding arrangement for a retractable thruster assembly with a movable thruster support pipe is disclosed. The guiding arrangement may comprise a foundation plate including a water-averted side, a water-facing side opposing the water-averted side, and an opening. The opening may extend between the water-averted side and the water-facing side for guiding the thruster support pipe. The guiding arrangement may further comprise a first upper guide arranged at the water-averted side of the foundation plate, and a second upper guide arranged at the water-averted side of the foundation plate and opposing the first upper guide with respect to the opening. The guiding arrangement may further comprise a first lower guide arranged at water-facing side of the foundation plate, and a second lower guide arranged at the water-facing side of the foundation plate and opposing the first lower guide with respect to the opening. The first lower guide and the second upper guide are arranged such that an arc angle within the range from 25° to 75° is confined therebetween.

According to a further aspect of the present disclosure, a retractable thruster assembly is disclosed. The retractable thruster assembly may comprise a thruster unit, a drive device, and a thruster support pipe connecting the thruster unit and the drive device. The retractable thruster assembly may further comprise a guiding assembly as exemplary disclosed herein.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1:
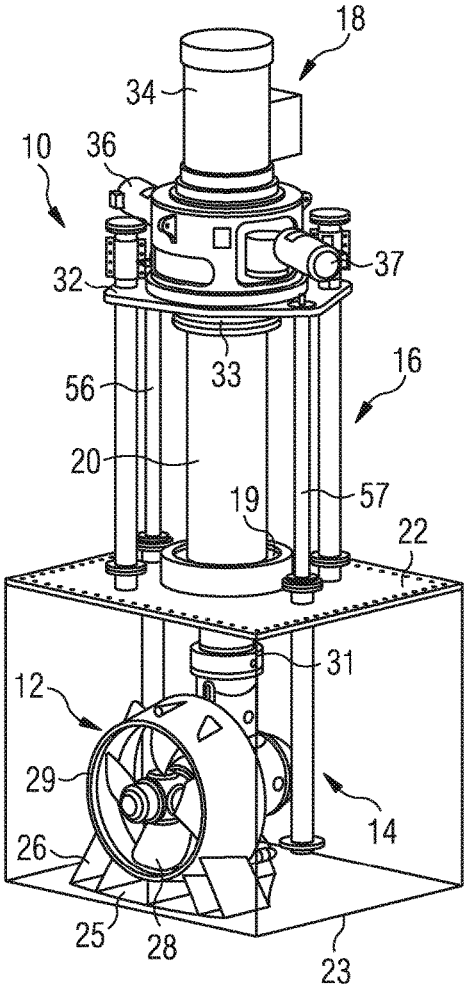
FIG. 1 shows a schematical drawing of an exemplary embodiment of a retractable thruster assembly in a retracted position.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure is based in part on the realization that a retractable thruster assembly may be designed such that it is not predetermined if that thruster assembly is configured as either an L-drive configuration, or a Z-drive configuration. Flexibility regarding the implementation of the retractable thruster as L-drive or Z-drive may be gained by an elaborated arrangement and design particularly in the section above the foundation plate where the drive device may be mounted, which drives a propeller of the retractable thruster assembly.

By arranging each of the lower guides close to a respective upper guide, unoccupied space extends between the first upper guide and the second lower guide, and between the second upper guide and the first lower guide, respectively. That unoccupied space may be used for arranging the prime mover also in a so-called Z-drive arrangement, which is not depicted in further detail here. Hence, the guiding arrangement according to the first aspect is not defined for implementation to either an L-drive or a Z-drive, but can be implemented as both configurations.

Additionally, the exemplified arrangement of the upper guides and close the lower guides allows a space saving arrangement for the retractable thruster assembly while still providing the required rigidity needed for proper retraction and extension.

Figure 2:
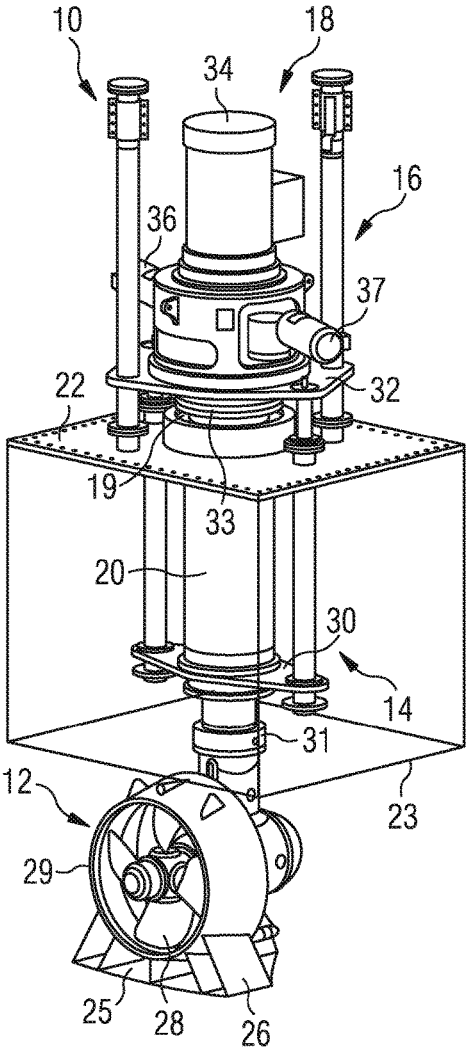
FIG. 2 show a schematical drawing of an exemplary embodiment of a retractable thruster assembly in an extended position.

Referring to FIGS. 1 and 2, an exemplary retractable thruster assembly is referred to by reference numeral 10 in its entirety. The retractable thruster assembly 10 comprises a thruster unit 12, guiding arrangement 14 and 16, a drive device 18, a thruster support pipe 20, and a foundation plate 22. Moreover, a (hoist) sealing assembly 19 is provided between the foundation plate 22 and the thruster support pipe 20 to provide a water-tight seal therebetween.

The thruster unit 12 is retractable into and extendable from a partially water-filled chamber 23 indicated schematically with dashed lines in FIGS. 1 and 2. Said chamber 23 is arranged within a hull of a marine ship or vessel. If a thrusting force by the thruster unit 12 is required, the same can be moved out of the chamber 23 into its extended position as depicted in FIG. 2. Otherwise, if no thrusting force by the thruster unit 12 is needed, the thruster unit 12 can be lifted into chamber 23 within the hull. In that retracted position as shown in FIG. 1, water resistance, which would result from the thruster unit 12 in an extended position, is substantially lowered. Here, the chamber 23 serves as a storage for the thruster unit 12, which is not intended to operate in the retracted position.

Alternatively, for example, the chamber 23 may form part of a tunnel, which may connect two sides of the hull. Here, the thruster unit 12 can be operated as a so-called tunnel thruster in case the thruster unit 12 is in the retracted position. In other words, the thruster unit 12 may not only generate a thrusting force in the extended position, but may also generate a thrusting force in the retracted position in the water-filled tunnel extending through the hull.

Below the thruster unit 12, a hull closing plate 25 is mounted via support fins 26 to the thruster unit 12 to close the bottom of chamber 23 in the retracted position, thereby, further lowering water resistance if retracted. To generate a thrust during operation, thruster unit 12 includes a propeller 28 surrounded by a nozzle 29. The propeller 28 has a plurality of blades, for example, four blades as depicted in FIGS. 1 and 2. Said blades may have a fixed pitch, or an adjustable pitch if desired.

For connecting the thruster unit 12 and the drive device 18, the thruster support pipe 20 is provided. Specifically, the thruster unit 12 is connected to a first end of the thruster support pipe 20 via a first flange 31, for example, by means of bolts or screws. In particular, in the shown embodiment, a rotatable inner stem, which provides the azimuthing functionality and is housed in the thruster support pipe 20, is connected with a first end via the first flange 31 to the thruster unit 12.

Similarly, the drive device 18 is connected to a second end, which opposes the first end, of the thruster support pipe 20 via a second flange 33. Inside the thruster support pipe 20, a driving shaft, which drivingly connects a prime mover 34 of the drive device 18 and the propeller 28, for example, via an angular gear housed in the thruster unit 12, is supported. Moreover, various hydraulic and/or lubricating lines and components may be arranged in the thruster support pipe 20.

As is be described in greater detail in connection with FIG. 3, during retraction and extension, the lower guides 14 guide a lower support plate 30 and the upper guides 16 guide an upper support plate 32 onto which the drive device 18 is mounted. Thus, the risk of the thruster assembly 10 to get stuck due to canting during retraction or extension may be reduced.

The drive device 18 supported on the upper support plate 32 includes a prime mover 34 for driving the propeller 28. Additionally, in the shown embodiment, two side motors 36, 37 are provided. The side motors 36, 37 are drivingly connected to the inner stem mounted in the thruster support pipe 20 enabling a rotation of said inner stem together with the thruster unit 12. As a result, the thruster unit 12 is rotatable about a longitudinal axis (axis of retraction and extension) of the thruster support pipe 20. Due to the possibility of rotating (azimuthing) the thruster unit 12, the retractable thruster assembly 10 is a so-called retractable azimuth thruster assembly. Alternatively, the retractable thruster assembly 10 may be a retractable fixed thruster assembly.

The foundation plate 22 is adapted for connecting to the ship or vessel foundation in a rigid and fixed manner, for example, via a plurality of bolts. Lower guides 14 substantially extend below the foundation plate 22, whereas upper guides 16 substantially extend above the foundation plate 22. In other words, the lower guides 14 are arranged at a water-facing side 22B of the foundation plate 22 (see FIG. 3). Said water-facing side 22B of the foundation plate 22 is opposed by a water-averted side 22A of the foundation plate 22. The upper guides 16 are arranged at said water-averted side 22A of the foundation plate 22.

Figure 3:
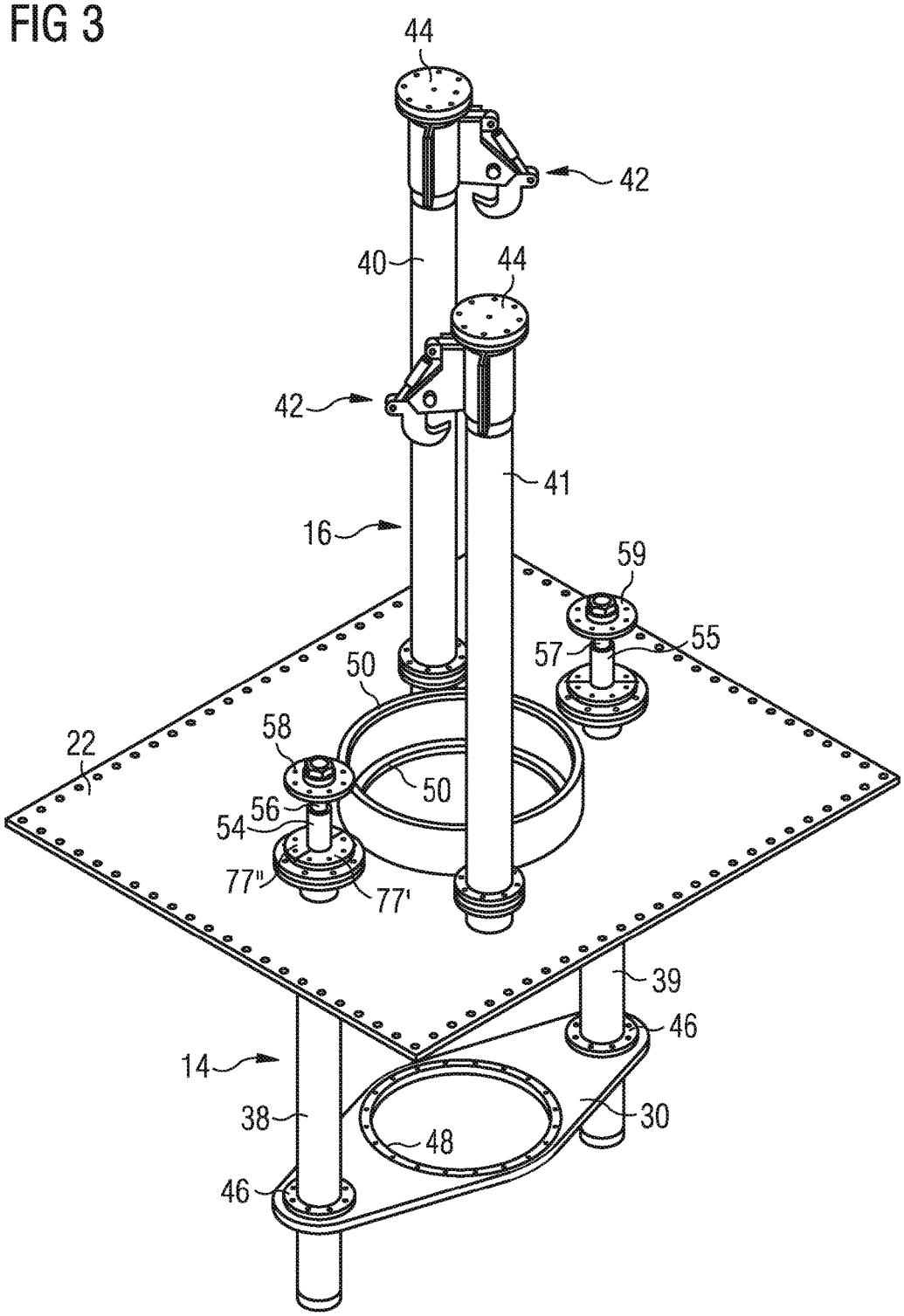
FIG. 3 shows a schematical drawing of a guiding arrangement of a retractable thruster assembly.

Turning to FIG. 3, the guides 14, 16 connected to the foundation plate 22 are shown in more detail. For the sake of clarity, the thruster unit 12, the thruster support pipe 20, and the drive device 18 together with the upper support plate 32 are omitted in FIG. 3.

In the shown embodiment, both the lower guides 14 and the upper guides 16 include exactly two guiding bars each. Specifically, a first lower guide 38 and a second lower guide 39 constitute the lower guides 14 arranged in the chamber 23 (depicted only in FIGS. 1 and 2). Similarly, a first upper guide 40 and a second upper guide 41 form the upper guides 14 in the shown embodiment. Alternatively, more or less than the two upper guides 16 and lower guides 14 as shown may be provided.

At the top ends of the upper guides 40 and 41, locking units 42 and support brackets 44 are provided.

By means of the locking units 42, the upper support plate 32 together with the drive device 18 (both not shown in FIG. 3) are securable in the retracted position of the thruster assembly 10. To secure the upper support plate 32 in the retracted position, the locking units 42 comprise locking hooks pivotable about pivot pins. A hydraulic or pneumatic cylinder is provided at each locking unit 42 to pivot the respective locking hook. The hooks of the locking units 42 can be hooked to locking lugs forming part of the upper support plate 32. Alternatively, the locking units 42 may be differently embodied, for example, as movable locking bars.

To rigidly install the thruster assembly 10 to the hull, not only the foundation plate 22 is connectable to the foundation, but also the upper and lower guides 14, 16 may be rigidly connectable to the hull. Specifically, in the shown embodiment, the support brackets 44 of the upper guides 16 facilitate a rigid connection, for example, via screws, to beams of the hull (not shown in further detail in FIG. 3). Analogous, lower ends of the lower guides 14 may be rigidly connectable to the hull to increase rigidity of the entire thruster assembly 10.

The lower support plate 30 comprises two openings 46 at opposing sides for guiding the lower support plate 30 along the lower guides 38, 39. Additionally, a central opening 48 is provided in the lower support plate 30 and connected to the thruster support pipe 20. The connection between the thruster support pipe 20 and the central opening 48 of the lower support plate 30 is chosen in dependence, for example, on the type of the retractable thruster assembly. In the case of a retractable azimuth thruster assembly, for example, the thruster support pipe 20 and the opening 48 may be connected in a manner enabling to azimuth the inner stem of the thruster support pipe 20, which may extend out of the thruster support pipe 20 at about the level of the lower support plate 30. At the same time, a sealing between the inner stem and the thruster support pipe 20 may be provided. In the case of a retractable fixed thruster assembly, for example, the thruster support pipe 20 and the opening 48 may be connected rigidly.

Figure 6:
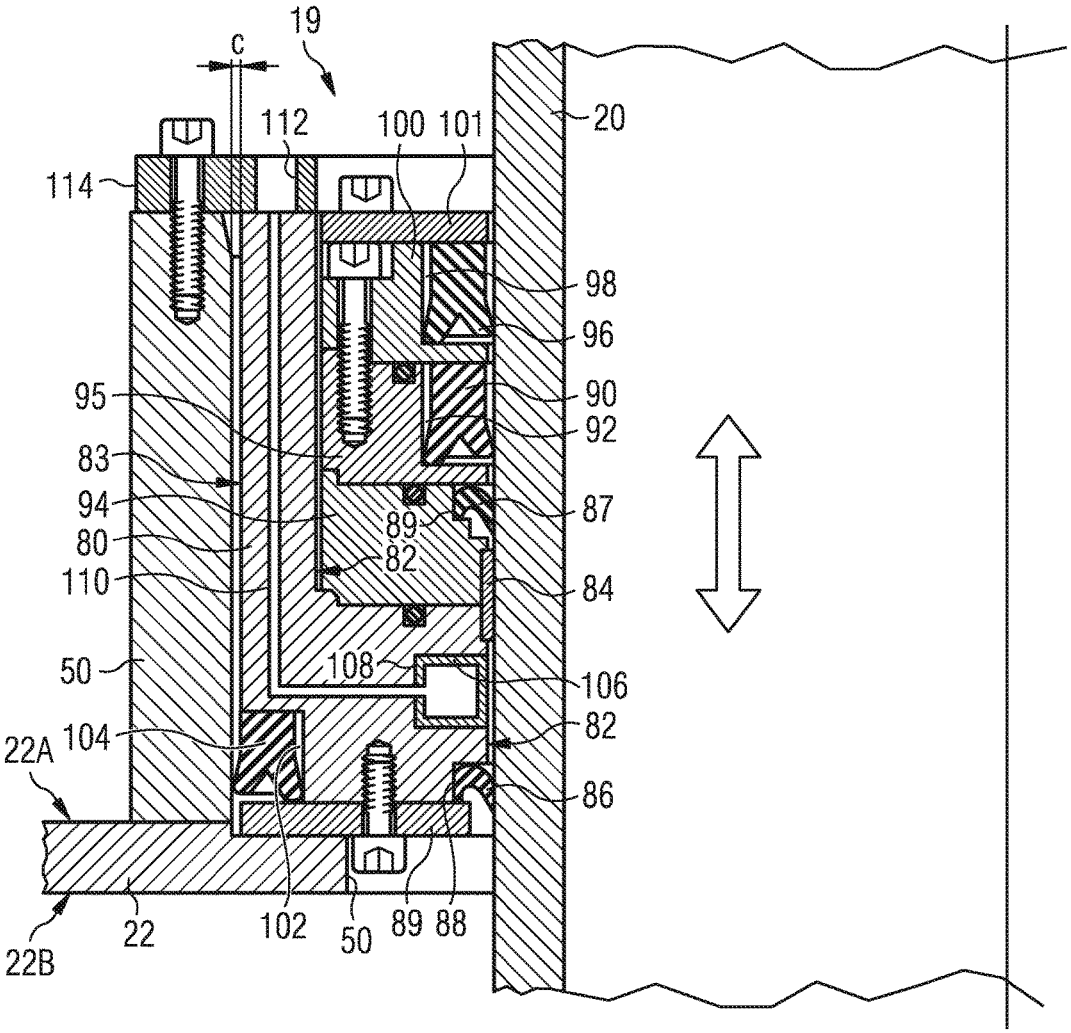
FIG. 6 shows a cut view of a sealing assembly of a retractable thruster assembly.

The thruster support pipe 20 is further guided through a central opening 50 in the foundation plate 22. At central opening 50, a sealing assembly 19, which is described in greater detail in connection with FIG. 6, is provided to seal between the thruster support pipe 20 and the central opening 50 in a water-tight manner.

Inside the lower guides 38 and 39, lifting devices for retracting and extending are installed. For example, hydraulic cylinders 54 and 55 are installed in a respective (hollow) chamber of the lower guides 38, 39. Each hydraulic cylinder 54, 55 comprises a movable piston 56 and 57. Ends of the movable pistons 56 are connectable to the upper support plate 32 (see, for example, FIGS. 1 and 2) via support brackets 58 and 59. By extending and retracting pistons 56 and 57 within cylinders 54 and 55, respectively, the support plate 32 together with the drive device 18, the thruster support pipe 20, the lower support plate 30, and the thruster unit 12 can be lifted and lowered. Specifically, in the extended position of the thruster assembly 10, the movable pistons 56 and 57 are retracted within the hydraulic cylinders 54 and 55 as shown in FIGS. 2 and 3. In the retracted position of the thruster assembly 10, the movable pistons 56 and 57 are extended, thereby, lifting the thruster unit 12 into the chamber 23 as can be seen in FIG. 1.

Alternatively, the first lifting device and/or the second lifting device may include a gear rod and a movable slide, or the first lifting device and/or the second lifting device may be a telescopic cylinder.

To relief the load onto the hydraulic cylinders 54, 55 in the extended position of the thruster assembly 10, mechanical end stops (not shown in further detail) may be provided on the foundation plate 22 to support the upper support plate 32 in the lowered position. Likewise, to relief the load onto the hydraulic cylinders 54 and 55 in the retracted position of the thruster assembly 10, which is the extended position of the movable pistons 56 and 57, the aforementioned looking units 42 are provided at ends of the upper guides 40 and 41, respectively.

Figure 4:
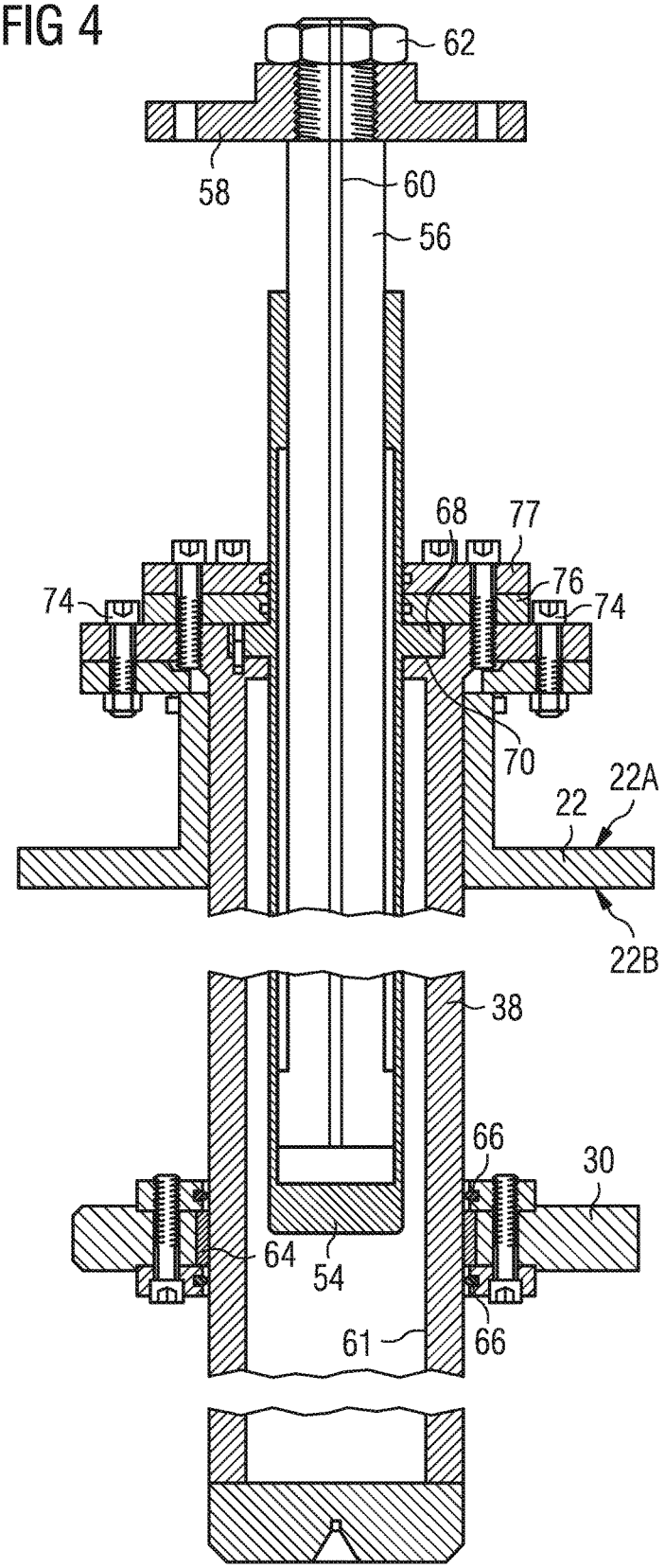
FIG. 4 shows a cut view of a guide with a hydraulic cylinder of a retractable thruster assembly.

As an example, the first lower guide 38 is depicted in FIG. 4 together with the first hydraulic cylinder 54 including the first movable piston 56. The first hydraulic cylinder 54 is detachably mounted in a bore 61 extending longitudinally through the guide 38. To extend the movable piston 56 for retracting the thruster assembly 10, a hydraulic fluid is supplied via an inner bore 60 (schematically indicated by a dashed line in FIG. 4), which extends longitudinally through the piston 56. In case the thruster assembly 10 shall be lowered into the extended position, the hydraulic fluid is drained through the inner bore 60. To limit the maximum retraction speed of the movable piston 56, a flow restriction valve may be installed in a drain line connected to the inner bore 60 for draining the hydraulic fluid. To connect hydraulic supply and drain line(s) to the inner bore 60, a connecting port 62 is provided at an outer end of the piston 56.

The lower support plate 30 is guidable along the outer circumference of the first lower guide 38 via a bearing 64. The bearing 64 facilitates up and down movement of the support plate 30 resulting from retraction and extension of the thruster assembly 10. As the first lower guide 38 is exposed to water within the chamber 23 (see FIGS. 1 and 2) and microorganisms living in the water, two lower guide scraper rings 66 are provided below and above the lower guide bearing 64, respectively. During movement of the support plate 30, the lower guide scraper rings scrape 66 growth from the outer circumference of the first lower guide 38 to smoothen the movement and/or to protect the lower guide bearing 64.

The hydraulic cylinder 54 comprises a mounting protrusion 68 to fixedly mount the first hydraulic cylinder 54 within the first lower guide 38, which in turn is rigidly connected to the foundation plate 22, for example, via a plurality of screws 74.

Specifically, the mounting protrusion 68 is placed in a recess 70 at an end side of the first lower guide 38. The mounting protrusion 68 is secured in the recess 70 by mounting of two layers of split-type mounting plates 76, 77, which are secured to the lower guide 38. For example, the upper securing plates 77 may be formed as two half ring segments 77' and 77" (see FIG. 3). In this case, the lower mounting plates 76 may also constitute as two half ring segments. The upper and lower securing plates are mounted in an off-set fashion. Specifically, the splits of the lower and upper mounting plates 76, 77 are placed not on top of each other, but turned about an angle, for example, about 90°. Bolts, screws and/or other connecting mechanisms may be used to detachably connect the mounting plates 76, 77, the mounting protrusion 68 of the hydraulic cylinder 54, an end side of the lower guide 38, and the foundation plate 22.

It should be noted that although the above explanation of FIG. 4 solely references to the first lower guide 38, the second lower guide 39 may be similarly embodied.

Figure 5:
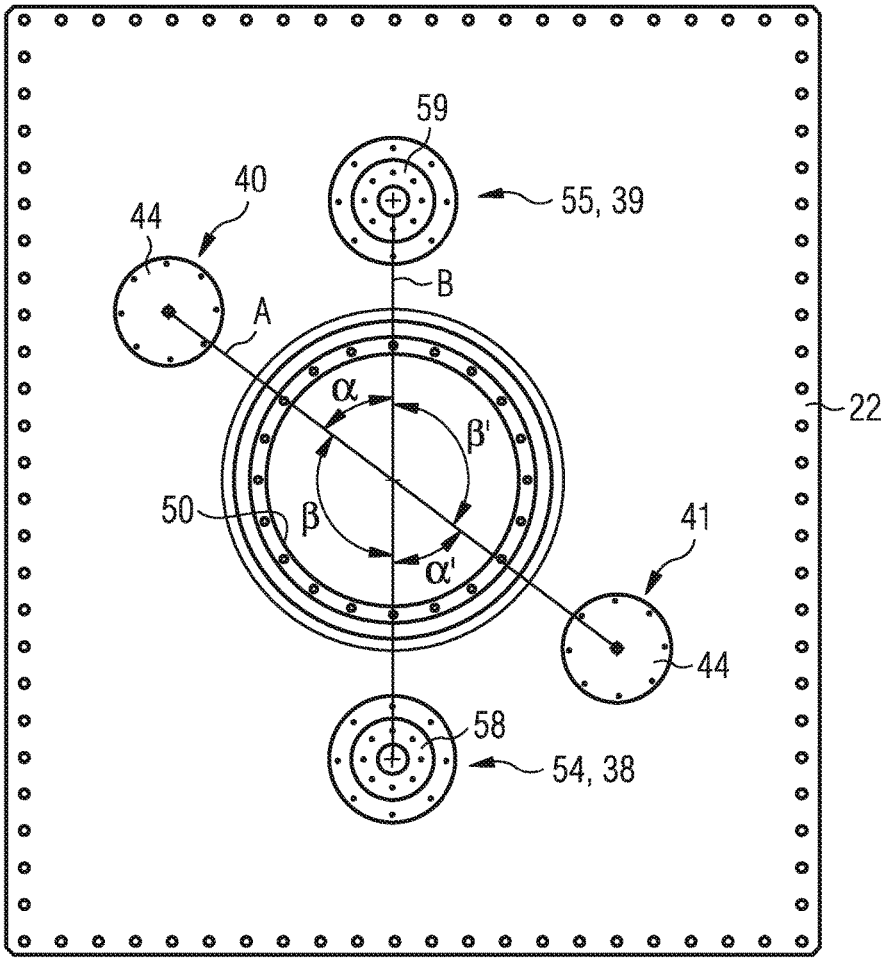
FIG. 5 shows a top view on the guiding arrangement of FIG. 3.

Referring now to FIG. 5, a top view onto the assembly depicted in FIG. 3 is shown.

The guides 38-41 are arranged around the central opening 50 for the thruster support pipe 20. In detail, the upper guides 40 and 41 are arranged on opposed sides of the central opening 50 in the foundation plate 22. Similarly, the lower guides 38 and 39 are arranged on opposed sides of the central opening 50. Furthermore, referring to the distances between the longitudinal axes of the guide bars, the first upper guide 40 is located closer to the second lower guide 39 than to the first lower guide 38. Analogous, the second upper guide 41 is located closer to the first lower guide 38 than to the second lower guide 39.

For example, an imaginary line A drawn in the level of the foundation plate 22 between a center point of the central opening 50 and a center point of the first upper guide 40 may confine an angle $\alpha$ with an imaginary line B drawn in the level of the foundation plate 22 between the center point of the central opening 50 and a center point of the second lower guide 39 within a range from 25° to 75°, for instance, about 50°.

Naturally, due to the symmetrical arrangement of the guides 38, 39 and 40, 41 on opposed sides of the opening 50, an arc angle $\alpha'$, which has the same value as the angle $\alpha$ referred to above, may then be confined between an imaginary line A' drawn in the level of the foundation plate 22 from the center point of the central opening 50 to a center point of the second upper guide 41 and an imaginary line drawn in the level of the foundation plate 22 from the center point of the central opening 50 to the first lower guide bar 38.

Arc angles β and β' as depicted in FIG. 5 sum up with the respective angles α and α' to 180°.

Turning to FIG. 6, the sealing assembly 19 between the thruster support pipe 20 and the opening 50 within the foundation plate 22 is described in the following. As indicated by the double ended arrow in FIG. 6, the thruster support pipe 20 is moveable relative to the sealing assembly 19.

The sealing assembly 19 includes a main body 80 with a radial inner side 82 and a radial outer side 83. The main body 80 has a substantial annular-shaped cross-section in a plane parallel to of the foundation plate 22, and, as can be seen in FIG. 6, a substantial L-shaped cross-section in a plane perpendicular to the foundation plate 22 (regarding only one side of the annular main body as depicted in FIG. 6).

To allow a relative movement between the thruster support pipe 20 and the main body 80, a support pipe bearing 84 is arranged at the radial inner side 82 of the main body 80, namely between the main body 80 and the thruster support pipe 20. The support pipe bearing 84 is formed as a friction bearing to allow a relative movement between the main body 80 and the thruster support pipe 20 such that retraction and extension of the retractable thruster assembly 10 is enabled.

The support pipe bearing 84 further ensures that the main body 80 is held in a concentric position relative to the thruster support pipe 20. As a result, the main body 80 follows the translatory movement of the thruster support pipe 20 in the plane of the foundation plate 22.

The main body 80 can follow the translatory movement of the thruster support pipe 20 due to the presence of a gap C between the outer radial side 83 of the main body 80 and the opening 50. For example, the width of the gap C may be in the millimeter-range such as about 2 mm, 5 mm, 10 mm, or 20 mm.

For cleaning the thruster support pipe 20 from growth, a first support pipe scraper ring 86 and a second support pipe scraper ring 87 are provided at the radial inner side 82 of the main body 80. Both scraper rings 86, 87 are in contact with the thruster support pipe 20. The first pipe scraper ring 86 is arranged in a first inner annular recess 88 at the radial inner side 82 of the main body 80. The first inner annular recess 88 is arranged such that the first pipe scraper ring 86 is the lowermost component of the sealing assembly 19, which contacts the thruster support pipe 20. In other words, if retracting the thruster unit 12, the first pipe scraper ring 86 is the first component of the sealing assembly 19, which gets in contact with an imaginary mark on the periphery of the thruster support pipe 20 moving into the retracted position.

At the radial inner side 82 of the main body 80, three cartridges 94, 95, 100 are stacked upon one another. The stack of cartridges 94, 95, 100 is arranged on top of the small leg of the L-shaped main body 80. The cartridges 94, 95, 100 are designed to house sealing and scraper rings. Specifically, a first cartridge 95 accommodates a first inner sealing ring 90, which seals between the radial inner side 82 of the main body 80 and the outer circumference of the thruster support pipe 20. Likewise, a second cartridge 100, which is positioned on top of the first cartridge 95 in the shown embodiment, is equipped with a second inner sealing ring 96, which also seals between the radial inner side 82 of the main body 80 and the outer circumference of the thruster support pipe 20. The third cartridge 94, which is positioned on top of the small leg of the L-shaped main body 80, houses the second pipe scraper ring 87.

In some embodiments, the cartridges 94, 95, 100 are of a split-type, which may comprise two ends connectable to one another to form an annular body in the installed state.

The first, second and third cartridge 94, 95, 100 comprise a substantial L-shaped cross-section to receive respective sealing or scraper rings. Particularly, the first cartridge 95 includes a sealing ring seat 92 for the first inner sealing ring 90, the second cartridge 100 includes a sealing ring seat 98 for the second inner sealing ring 96, and the third cartridge 94 includes a scarper ring seat 88 for the second pipe scraper ring 87. Alternatively, the cartridges 94, 95, 100 may comprise any other cross-section including at least one recess to receive at least one sealing ring and/or scraper ring insertable into the recess to contact the outer circumference of the thruster support pipe 20 in a desired manner for providing a sealing and/or scraping function. For example, the cross-section may constitute as reversed L-shape (F-shape), E-shape, C-shape, or combinations thereof.

In the shown embodiment, the second cartridge 100 is positioned on top of the first cartridge 95, which in turn is positioned on top of the third cartridge 94. Said third cartridge 94 is positioned on top of the small leg of the L-shaped main body 80. Each cartridge 94, 95, 100 is attached to the adjacent cartridge by means of bolts or screws (only one of which is shown in FIG. 6 for the sake of clarity), which are arranged in an off-set fashion with respect to one another.

Between the individual cartridges 94, 95, 100, sealing o-rings are provided to seal between the contacting faces of the cartridges 94, 95, 100. The sealing o-rings are provided in circumferential grooves of the cartridges 94, 95, 100. Alternatively or additionally, o-rings and respective grooves may be provided in outer radial faces of the cartridges 94, 95, 100 to seal between the main body 80 and the respective cartridge 94, 95, 100.

The outer radial diameter of the cartridges 94, 95, 100 is dimensioned such that, in the assembled state, a gap between the outer radial face of the respective cartridge 94, 95, 100 and the long leg of the L-shaped main body 80 is provided. Said gap may help to ease assembling and disassembling the sealing assembly 19 since the risk of canting during insertion and removing of the cartridges 94, 95, 100 may be reduced. Furthermore and as can be exemplary seen in FIG. 6, stacking and centering of the cartridges 94, 95, 100 may be alleviated due to the presence of lips matching with recesses in contacting faces of the cartridges 94, 95, 100.

Additionally, an outer sealing ring 104 is arranged at the radial outer side 83 of the main body 80 in an annular sealing ring seat 102. The outer sealing ring 104 bridges the gap C and seals against the opening 50 of the foundation plate 22 while allowing radial movement of the main body 80 within the opening 50.

The sealing rings 90, 96, 104 are formed as V-seals having a V-type cross-section with odd legs. Alternatively, at least one sealing ring 90, 96, 104 may have another suitable cross-section such as, for example, an o-type cross-section.

Moreover, the inner sealing rings 90, 96 are designed as split seals. Before installation, those split seals have two ends which can be (re-) joined, for example, by hot bonding, to create a split-free sealing ring. Likewise, the second pipe scraper ring 87 is designed as split-type scraper. However, not only the sealing rings 90, 96 and the scraper ring 87 are formed as split-type, but also the respective cartridges 94, 95, 100 housing the same.

To lubricate the inner sealing rings 90, 96, grease can be provided into the annular space between the first inner sealing ring 90 and the second inner sealing ring 96 through a supply port not shown in detail in FIG. 6.

In the inner radial portion of the short leg of the L-shaped main body 80, a circumferential recess 108 is provided. An inflatable sealing ring 106 is arranged in the circumferential recess 108. Said inflatable sealing ring 106 can be supplied with pressurized air via an inner supply channel 110 extending from the recess 108 through the main body 80 to an air supply port 112.

If not inflated, the inflatable sealing ring 106 is not in sealing contact with the thruster support pipe 20, which means that no sealing effect is caused by the inflatable sealing ring 106. However, if inflated, an inner radial face of the inflatable sealing ring 106 extends in direction of the thruster support pipe 20 until getting in contact with the outer radial face of the same. Thereby, a sealing contact is established between the inner radial face of the inflatable sealing ring 106 and the outer radial face of the thruster support pipe 20.

In the embodiment shown in FIG. 6, the first inner scraping ring 90, the inflatable sealing ring 106, the sliding bearing 84, the second inner scraper ring 87, the first inner sealing ring 90, and the second inner sealing ring 96 are arranged in the aforementioned order in direction from the water-facing side 22B of the foundation plate 22 to the water-averted side 22A of the foundation plate 22. Alternatively, the aforementioned elements of the sealing assembly 19 may be ordered differently, and/or some of the aforementioned element may be omitted. For example, the sealing assembly 19 may not comprise the second inner sealing ring 96.

A detachable annular top plate 101 and a detachable annular bottom plate 89 are enclosing the sealing assembly 19 to hold the same in position within the opening 50. The plates 101, 89 may be connected to the sealing assembly 19 by means of, for example, screws or bolts.

INDUSTRIAL APPLICABILITY

Hereinafter, the aspects of the present disclosure are described in further detail in connection with FIGS. 1 to 6.

During retraction and extension as well as during operation of the thruster assembly 10, the thruster support pipe 20 may move radially in any direction perpendicular to the retraction direction. Even if that radial movement of the thruster support pipe 20 may be lowered by guiding the thruster assembly 10 by means of the lower and upper guides 14 and 16, radial movement of the thruster support pipe 20 may be not entirely prevented.

In a conventional sealing assembly, the radial movement of the thruster support pipe may generate excessive radial forces affecting the sealing rings and scraper rings of that conventional sealing assembly. Accordingly, the conventional sealing assembly may be subject to increased wear and failure.

On the contrary, the sealing assembly 19 according to the first aspect of the present disclosure is designed to follow the radial movement of the thruster support pipe 20. Hence, radial forces on the sealing rings 90, 96 and scraper rings 86, 87 resulting from the radial movement of the thruster support pipe 20 may be considerably reduced, which may decrease wear of the same. A thus increased service-life of the sealing assembly 19 may reduce cost for maintenance and replacement of the sealing assembly 19.

In this respect, it has to be understood that the lower guides 14 and the upper guides 16 may already considerably reduce radial movement of the thruster support pipe 20, but may not be able to perfectly guide the thruster assembly 10 during retraction and extension. Moreover, the lower guides 14 and the upper guides 16 may not be able to hold the thruster assembly 10 perfectly in position particularly if the thruster unit 12 is operated to generate a thrusting force. The remaining radial movement of the thruster support pipe 20, which cannot be fully prevented from occurring, may be balanced by the gap C to reduce negative effects on the sealing assembly 19. Accordingly, the gap C between the opening 50 of the foundation plate 22 and the outer diameter of the main body 80 are dimensioned such that the main body 80 can radially move with the thruster support pipe 20 to a certain extend. The width of the gap C is chosen based on the dimension of the retractable thruster assembly 10 and the expectable radial movement of the thruster support pipe 20. In embodiments including upper and lower guides 14, 16 as disclosed herein, the width of the gap C may be smaller than in embodiments including no upper and/or lower guides.

FURTHER ASPECTS

In the following, further aspects of the present disclosure are described. Those aspects include features described herein in connection with the description of the first aspect and FIGS. 1 to 6.

According to a second aspect of the present disclosure, a sealing assembly for sealing between a movable thruster support pipe of a retractable thruster and a foundation plate with an opening is disclosed. The sealing assembly may comprise an inflatable seal configured to seal between the opening and the thruster support pipe in an inflated state.

The second aspect of the present disclosure is based in part on the realization that the corrosive influences on the sealing between ship foundation and retractable thruster support pipe are so high that the sealing may have to be replaced routinely at certain time intervals. That replacement may be time consuming, labor-intensive, and may even require the marine vessel to be situated in a dry dock for replacement. Accordingly, a sealing configuration, which requires less time and labor, and no dry dock for replacement, is generally desirable.

The inflatable sealing ring may serve as both a service seal and an emergency seal. Utilized as service seal, the inflatable sealing ring is inflated if maintenance of the sealing assembly is required. The inflated sealing ring takes over the sealing function and allows replacement of worn elements of the sealing assembly without requiring a dry dock. Particularly, the first and/or second sealing rings and/or the scraper ring are replaceable. Replacement is made possible due to the split-type of the sealing rings and the scraper ring.

Moreover, the inflated sealing ring may serve as an emergency seal in case the sealing effect of the further sealing rings may be not sufficient any more.

In some embodiments, the sealing assembly may further comprise a main body including a radial inner side and a radial outer side. The main body may include a recess for housing the inflatable sealing ring.

The main body may further comprise an air supply channel for providing air to the inflatable sealing ring.

Additionally or alternatively, the sealing assembly may, individually or in combination, comprise any feature of the sealing assembly disclosed in connection with the first aspect.

According to a third aspect of the present disclosure, a guide for guiding a retractable thruster assembly during retraction and extension may comprise a bore, and a hydraulic cylinder detachably mounted in the bore. The hydraulic cylinder may include a movable piston.

The third aspect of the present disclosure is based in part on the realization that overall serviceability of a retractable thruster assembly has to be improved. Therefore, arrangement and design of individual components of the retractable thruster assembly, which may have a limited service-life in comparison to the other components of the retractable thruster assembly, may be revised to allow replacement of the same without the need to disassemble the entire retractable thruster assembly, which might be only possible in a dry dock. Furthermore, operator access to those critical components also needs to be improved.

Due to providing the hydraulic cylinder in a detachable manner within the guide, the hydraulic cylinder is replaceable, for example, for maintenance. Thereby, the guiding arrangement does not have to be disassembled as a whole, which may ease replacement of the hydraulic cylinder.

The guide may further comprise at least one detachable mounting plate fixing the hydraulic cylinder in the bore.

For example, each of the at least one detachable mounting plate may be of a split-type, for example, comprising two half rings.

Additionally, the movable piston may include an inner supply bore for supplying and/or draining hydraulic fluid to or from the hydraulic cylinder.

According to a fourth aspect of the present disclosure, a sealing assembly for sealing between a movable thruster support pipe of a retractable thruster assembly and a foundation plate with an opening is disclosed. The sealing assembly may comprise an annular main body including a radial inner side and a radial outer side. The sealing assembly may further comprise a first inner sealing ring arranged at the radial inner side of the main body and configured to seal against the thruster support pipe, and a sliding bearing arranged at the radial inner side of the main body and configured to hold the main body in a concentric position in relation to the thruster support pipe. The sealing assembly may further comprise an outer sealing ring arranged at the radial outer side of the main body and configured to seal against the opening while allowing radial movement of the main body within the opening.

The fourth aspect of the present disclosure is based in part on the realization that a retractable thruster assembly makes high demands on the sealing between ship foundation and retractable thruster support pipe, which supports a thruster unit creating the thrusting force in operation. In particular, the sealing may have to cope with high radial forces resulting from slight radial movements of the heavy thruster support pipe, which cannot be perfectly guided during retraction and extension of the thruster assembly and cannot be perfectly hold in position during operation of the thruster unit.

The sealing assembly may further comprise a second inner sealing ring arranged at the radial inner side of the main body and configured to seal against the thruster support pipe.

The sealing assembly may further comprise an inflatable sealing ring arranged at the radial inner side of the main body.

The sealing assembly may further comprise at least one scraper ring arranged at the radial inner side of the main body and configured for scraping the thruster support pipe.

The main body may further comprise an inner supply channel connected to the inflatable sealing ring.

Further, at least one of the sealing ring may have an odd leg V-shaped cross-section.

Still further, at least one of the sealing rings may be a split-type seal.

The first inner sealing ring may be arranged closer to a water-averted side of the foundation plate than the sliding bearing.

A first inner scraper ring may be arranged closer to a water-facing side of the foundation plate than the sliding bearing.

A first inner scraper ring, the inflatable sealing ring, the sliding bearing, a second inner scraper ring, the first inner sealing ring, and the second inner sealing ring may be arranged in the aforementioned order in direction from a water-facing side of the foundation plate to a water-averted side of the foundation plate.

The sealing assembly may further comprise a first cartridge accommodating the first inner sealing ring, and/or a second cartridge accommodating the second inner sealing ring, and/or a third cartridge accommodating a pipe scraper ring.

At least one of the cartridges may be of a split-type form.

An outer diameter of the main body may be smaller than an inner diameter of the opening to define a preset gap therebetween to allow radial movement of the main body within the opening.

The sealing assembly may further comprise a foundation plate with a central opening, wherein an inner diameter of the central opening is greater than an outer diameter of the main body to define a preset gap therebetween.

It should be noted that each recited aspect of the present disclosure and embodiments thereof may be combined with other aspects and embodiments thereof. As one skilled in the art will further appreciate, each individual aspect and embodiment recited herein may also be combined with any feature described in connection with FIGS. 1 to 6 where applicable.

Although the preferred embodiments of this invention have been described herein, improvements and modifications may be incorporated without departing from the scope of the following claims.

The invention claimed is:

1. A guiding arrangement for a retractable thruster assembly with a movable thruster support pipe, the guiding arrangement comprising:

a foundation plate including:

a water-averted side;

a water-facing side opposing the water-averted side;

an opening extending between the water-averted side and the water-facing side for guiding the thruster support pipe;

a first upper guide arranged at the water-averted side of the foundation plate;

a second upper guide arranged at the water-averted side of the foundation plate and opposing the first upper guide with respect to the opening;

a first lower guide arranged at the water-facing side of the foundation plate; and a second lower guide arranged at the water-facing side of the foundation plate and opposing the first lower guide with respect to the opening, wherein the first lower guide and the second upper guide are arranged such that an arc angle within the range from 25° to 75° is confined therebetween, wherein the first upper guide is located closer to the second lower guide than to the first lower guide; and/or the second upper guide is located closer to the first lower guide than to the second lower guide.

2. The guiding arrangement of claim 1, further comprising an upper support plate configured to be guided along the first upper guide and the second upper guide.

3. The guiding arrangement of claim 2, wherein the retractable thruster assembly comprises a drive device, and the upper support plate is configured to support the drive device.

4. The guiding arrangement of claim 2, further comprising locking units arranged at top ends of the first upper guide and the second upper guide to secure the upper support plate in a retracted position of the retractable thruster assembly.

5. The guiding arrangement of claim 1, further comprising a lower support plate configured to be guided along the first lower guide and the second lower guide.

6. The guiding arrangement of claim 5, wherein the lower support plate further comprises a central opening configured to be connected to the thruster support pipe.

7. A guiding arrangement for a retractable thruster assembly with a movable thruster support pipe, the guiding arrangement comprising:

a foundation plate including:

a water-averted side;

a water-facing side opposing the water-averted side;

an opening extending between the water-averted side and the water-facing side for guiding the thruster support pipe;

a first upper guide arranged at the water-averted side of the foundation plate;

a second upper guide arranged at the water-averted side of the foundation plate and opposing the first upper guide with respect to the opening;

a first lower guide arranged at the water-facing side of the foundation plate; and a second lower guide arranged at the water-facing side of the foundation plate and opposing the first lower guide with respect to the opening, wherein the first lower guide and the second upper guide are arranged such that an arc angle within the range from 25° to 75° is confined therebetween a first lifting device accommodated in the first lower guide and configured to extend in the direction of the upper guides for retraction of the retractable thruster assembly, and/or a second lifting device accommodated in the second lower guide and configured to extend in the direction of the upper guides for retraction of the retractable thruster assembly.

8. The guiding arrangement of claim 7, wherein the first lifting device and/or the second lifting device is a hydraulic cylinder with a movable piston for lifting and lowering the retractable thruster assembly.

9. The guiding arrangement of claim 7, wherein the first lifting device and/or the second lifting device is a telescopic cylinder.

10. The guiding arrangement of claim 7, wherein the first lifting device and/or the second lifting device include a gear rod and a movable slide.

* * * * *